US006394196B1

(12) United States Patent
Fanuel et al.

(10) Patent No.: US 6,394,196 B1
(45) Date of Patent: May 28, 2002

(54) CORE DRILL

(75) Inventors: Philippe Fanuel; Philippe Cravatte, both of Brussels; Olivier Lefevre, Drogenbos, all of (BE)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/529,652

(22) PCT Filed: Apr. 29, 1998

(86) PCT No.: PCT/BE98/00136

§ 371 (c)(1),
(2), (4) Date: Apr. 17, 2000

(87) PCT Pub. No.: WO99/20870

PCT Pub. Date: Apr. 29, 1999

(30) Foreign Application Priority Data

Oct. 17, 1997 (BE) ..... 09700829

(51) Int. Cl.[7] ..... E21B 49/02
(52) U.S. Cl. ..... 175/245; 175/250; 175/253
(58) Field of Search ..... 175/58, 245, 250, 175/253, 332, 403

(56) References Cited

U.S. PATENT DOCUMENTS 2,893,691 A * 7/1959 Johnson
4,452,321 A 6/1984 Eriksson
4,553,613 A 11/1985 Radford
6,116,358 A * 9/2000 Fanuel ..... 175/250
6,145,604 A * 11/2000 Bartette ..... 175/250

FOREIGN PATENT DOCUMENTS

| | | |
|---|---|---|
| WO | WO 91/19075 | 12/1991 |
| WO | WO 97/26438 | 7/1997 |
| WO | WO 97/46790 | 12/1997 |

* cited by examiner

*Primary Examiner*—William Neuder
(74) *Attorney, Agent, or Firm*—Carlos A. Torres; Browning & Bushman P.C.

(57) ABSTRACT

A double-tube core drill wherein the inner tube (2) is connected to the outer tube (1) by a multi-element needle and/or ball bearing (11), allows for the inner tube (2) to be made rigid and prevents it from rotating along with the outer tube (1). The extraction device (9) and the inner wall (38) of the tube are preferably covered with an antifriction coating. A set of stabilizing elements (67) are spread along the outer tube to stabilize the inner tube (2). Said inner tube has a tapered shoe (32) provided with a lower bevelled lip (14). The drill also comprises a device for indicating that the core has jammed in the inner tube (2) and a sealing device (19) designed to receive a ball (46) provided for sealing the inner tube (2) of said core drill.

4 Claims, 5 Drawing Sheets

CORE DRILL

BACKGROUND OF THE INVENTION

The present invention relates to a core drill, in particular for oil prospecting, comprising a core bit, an outer tube supporting the core bit so as to drive its rotation for core drilling, and an inner tube mounted in the outer tube so that it can receive a core sample cut by the bit. A flow space provided between the outer and inner tubes is intended for the passage of a coring fluid to be conveyed to the bottom of a hole during core drilling.

There is a constant need to improve the operation of core drills, for example by adding to them auxiliary devices which improve the reliability of the operations of taking hold of a core sample which has been cut around its periphery and which has to be detached from the bottom of the bore hole in order to bring it up to the surface. The way in which the auxiliary device or devices themselves work must, for its own part, be controllable from the surface so that they can act at the desired moment and in the intended way, with the lowest possible risk of losing or damaging the core sample, damaging the core drill, etc, given the enormous cost involved in terms of labor and time for performing such core drilling operations which have therefore to be successfully completed as quickly as possible.

SUMMARY OF THE INVENTION

The object of the present invention is to provide simple and effective means for controlling these auxiliary devices without introducing sophisticated and/or delicate mechanisms in the core drill but making best use of the possibilities, known as being such, offered by the use of modifications to the pressure of the core drilling fluid.

To this end, in the core drill of the invention, means for restricting the passage of core drilling fluid are arranged in the flow space at the front end side of the inner tube, viewed according to a direction of advance of a core sample, and in addition, control means are provided for adjusting, from the surface, the restricting means so as to substantially increase the pressure of said fluid upstream of the restricting means.

This increase in the pressure of the core drilling fluid can thus be exploited directly and effectively at the front end of the core drill in order to actuate the aforementioned auxiliary devices there.

According to one embodiment of the invention, the passage-restricting means comprise for this purpose an element of inner tube and an element of outer tube which elements collaborate to produce the adjustable restriction, and the control means are designed to move the inner and outer tubes one with respect to the other.

In another embodiment of the invention, the passage-restricting means comprise for this purpose an element of inner tube and/or an element of outer tube and an auxiliary element designed to collaborate with the element of inner tube and/or the element of outer tube with a view to adjusting the restriction. The control means may therefore be designed for this purpose to move the inner and/or outer tubes and/or the auxiliary element one with respect to the other.

As a preference, in the core drill of the invention, at least one of said elements of inner and/or outer tubes is an annular boss of which one peripheral surface facing toward the other tube element collaborates with a peripheral surface of this other element to form the restriction.

Advantageously, the control means may be designed to move the inner and outer tubes longitudinally one with respect to the other with a view to adjusting the restriction, the inner tube preferably being moved towards the front end of the core drill during this adjustment. For this purpose, the control means may comprise, on the rear end side of the inner tube, a cylinder and piston assembly with a relatively limited travel, one of the piston and cylinder being secured to the inner tube and the other being secured to the outer tube. A catch may be fitted so as to be able to lock the piston in the cylinder in a position corresponding to a chosen minimum restriction (relatively large passage). In addition, the catch may be fitted so as to unlock the piston from the cylinder when a determined pressure of core drilling fluid, higher than the core-drilling pressure, is applied to the catch. The limited relative travel of piston relative to cylinder as a result of a pressure which is still higher, brings then the restricting means from the front end of the inner tube into a position of chosen maximum restriction (relatively small passage).

In the core drill of the invention, one type of auxiliary device may comprise, arranged coaxially in the front end of the inner tube, a sleeve with deformable wall which, in the undeformed condition, allows a core sample to pass, and a substantially impervious annular chamber contained between the inner tube and the wall of the sleeve, this chamber being in communication with the core drilling fluid passing through the flow space between the outer and inner tubes. The wall of the sleeve is chosen to deform toward the inside of the inner tube until the internal space thereof is substantially closed up and/or closed so as to retain a core sample located therein, under the pressure of said fluid which pressure is obtained in the annular chamber after an aforementioned adjustment of the pressure by the chosen maximum restriction.

Another type of auxiliary device for the core drill of the invention may comprise, arranged coaxially in the front end of the inner tube, a sliding ring allowing the passage of a core sample and mounted in the manner of a piston in a substantially impervious annular chamber contained between the inner tube and this ring, this chamber being in communication with the core drilling fluid passing through the flow space between the outer and inner tubes. The sliding ring is then designed to, on the one hand, occupy a first position slid towards the front end of the core drill and be preferably locked therein by a catch, and, on the other hand, be slid into a second position away from the front end of the core drill under the pressure of said fluid which pressure is obtained in the annular chamber after the increase in the aforementioned pressure by the chosen maximum restriction, after any catch there might be has released the ring under the action of said pressure on the ring.

Further details and particulars of the invention will become apparent from the secondary claims and from the description of the drawings which are appended to this description and which illustrate, diagrammatically and in longitudinal section, with cutaway and possibly different scales, and as non limiting examples, some advantageous embodiments of core drills according to the invention.

DESCRIPTION OF THE ILLUSTRATED EMBODIMENTS

Figure 1:
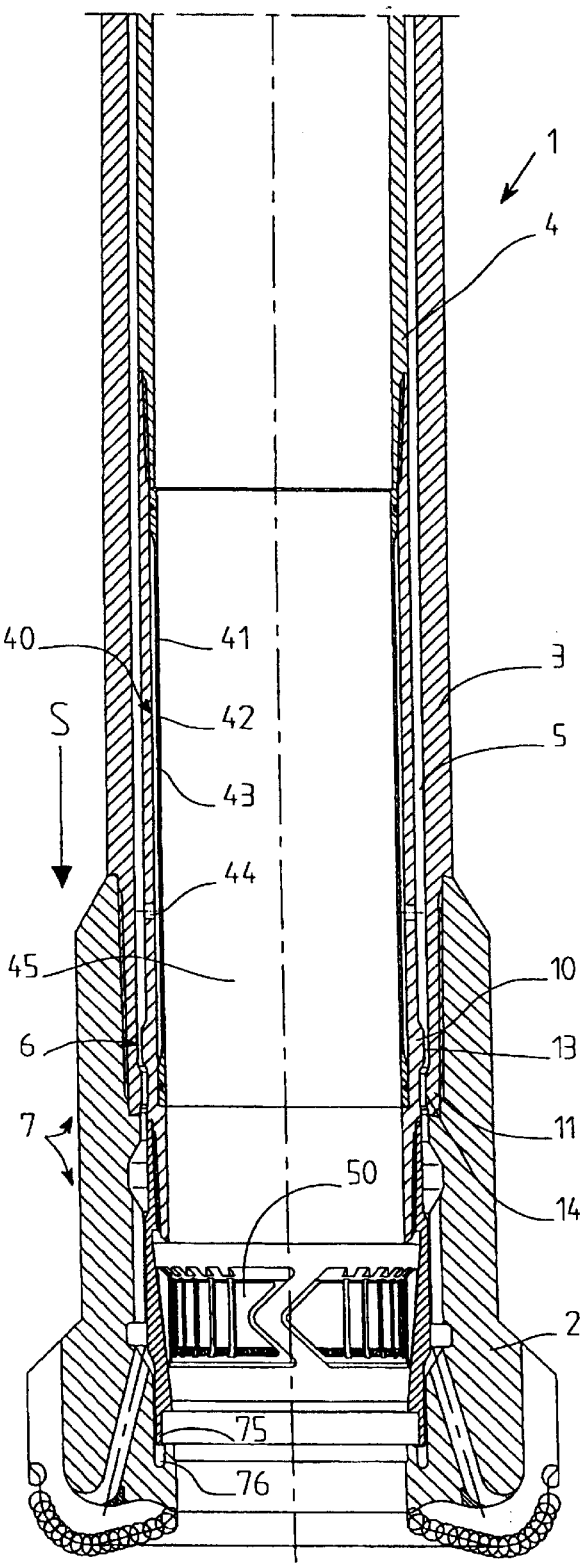
FIG. 1 depicts a front end of one embodiment of the core drill of the invention, equipped with an auxiliary device.

In the various figures, the same reference notation is used to denote elements which are identical or similar.

The core drill 1 of the invention usually comprises (FIGS. 1, 3, 4, 5 and 7), a core bit 2, an outer tube 3 supporting the bit 2, so as to drive its rotation for core drilling, and an inner tube 4 mounted in the outer tube 3 in such a way that it can take a core sample (not depicted) cut by the core bit 2. A flow space 5 provided, among other things, between the outer 3 and inner 4 tubes is intended for the passage of a core drilling fluid to be conveyed to the bottom of a hole during core drilling, through nozzles pierced in the bit 2.

According to the invention, the core drill 1 additionally comprises, on the one hand (FIGS. 1, 3, 4, 5 and 7), means 6 for restricting the passage of fluid, which means are arranged in the flow space 5, on the same side as or near to the front end 7 of the inner tube 4, viewed according to a direction of advance S of a core sampling and of the flow of core drilling fluid in this space 5 and, on the other hand (FIGS. 2 and 6) control means 8 which are designed, preferably at the rear end 9 side of the inner tube 4, for adjusting the restricting means 6 from the surface so as to be able to substantially increase a pressure of said fluid upstream of these restricting means 6.

According to one preferred embodiment of the invention, the passage-restricting means 6 for this purpose comprise an element 10 of the inner tube 4 and an element 11 of the outer tube 3 which collaborate to produce the adjustable restriction. The control means 8 are then designed to move one with respect to the other the inner 4 and outer 3 tubes to which the elements 10 and 11 respectively are attached.

Given that the inner 4 and outer 3 tubes usually turn one with respect to the other about their known longitudinal axis, it is advantageous for the control means 8 to be arranged in such a way as to move the inner 4 and outer 3 tubes longitudinally one with respect to the other with a view to adjusting the restriction, the inner tube 4 preferably being moved towards the front end 7 of the core drill 1 (in the direction of the arrow S) during this adjustment.

According to another embodiment of the invention, the passage-restricting means 6 may for this purpose comprise an aforementioned inner tube element 10 and/or an aforementioned outer tube element 11 and an auxiliary element, not depicted, designed to collaborate with the inner tube element 10 and/or the outer tube element 11 for adjusting the restriction. This auxiliary element could be a ring placed between the inner 10 and outer 11 tubes, in the flow space 5. In this case, the control means 8 may then be designed to move the inner 4 and/or outer 3 tubes and/or the auxiliary element one with respect to the other.

For the reasons mentioned hereinabove, in the case of this other embodiment, the control means 8 may be designed to move the auxiliary element longitudinally with respect to the inner 4 and/or outer 3 tubes with a view to adjusting the restriction.

To make the restricting means 6 easy to shape, at least one of the two elements 10, 11 of inner 4 and/or respectively outer 3 tubes is an external annular boss 13 or respectively internal annular boss 14. For example, an external peripheral surface of the external annular boss 13 or of the element 10 itself, facing towards the other tube element 11, collaborates with an internal peripheral surface of this other element 11 or of its annular boss 14 to form the restriction.

Likewise, the aforementioned auxiliary element could be equipped with an internal annular boss and/or with an external annular boss designed to collaborate, respectively, in order to obtain the restriction, with the inner tube element 10 which may or may not be equipped with a corresponding boss, and/or with the outer tube element 11 which likewise may or may not be equipped with a corresponding annular boss.

To actuate the restricting means 6 explained hereinabove, by means of an aforementioned longitudinal movement, the control means 8 may comprise, on the rear end 9 side of the inner tube 4, a system which will be known as a cylinder 22 and piston 23 system with a relatively limited travel because, among others, one is arranged to slide inside the other. For example, the cylinder 22 (FIG. 2) is secured to the inner tube 4 and the piston 23 is secured to the outer tube 3 via the thrust ball bearing 25 designed for suspending the inner tube 4 inside the outer tube 3. A catch 24 is advantageously provided to prevent any relative longitudinal movement of the piston 23 with respect to the cylinder 22 when these elements are in a starting position corresponding to usual core drilling with a chosen minimum restriction. The catch 24 is then designed to be able to unlock the cylinder 22 from the piston 23 when a determined pressure of the core drilling fluid, higher than that of normal core drilling, is applied to the catch 24.

Figure 2:
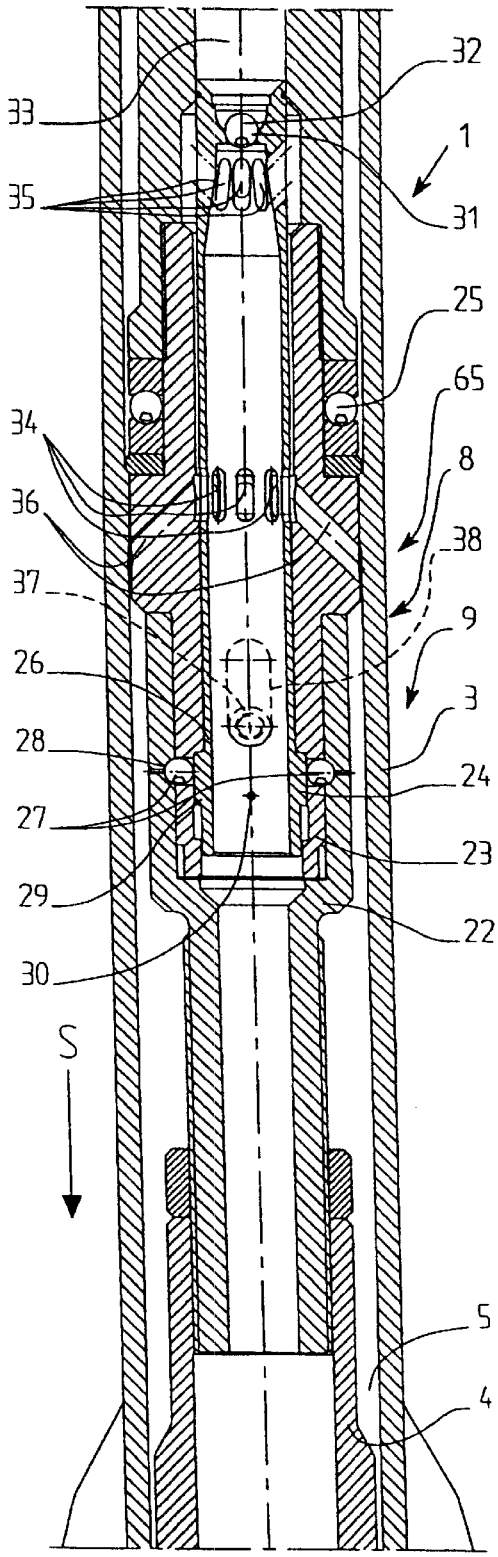
FIG. 2 depicts one embodiment of a portion of the core drill of the invention at the location of the rear end of the inner tube.
Figure 3:
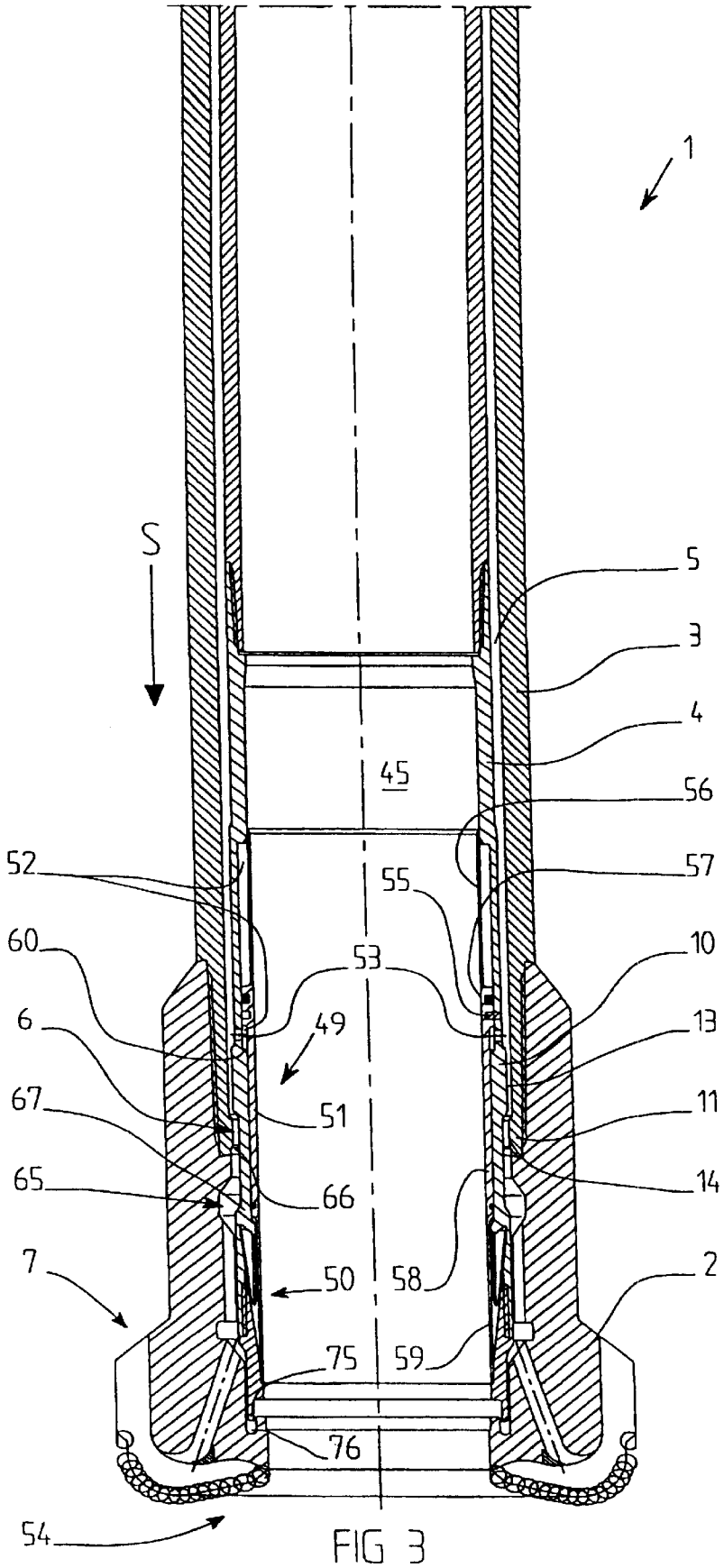
FIG. 3 depicts a front end of one embodiment of the core drill of the invention, equipped with another auxiliary device.

The catch 24 of FIG. 2 may, for example, comprise a tube 26 which can slide in the piston 23, and balls 27 housed in radial cylindrical holes, through the wall of the piston 23 and projecting into appropriate indentations, or into an annular groove 28, cut in the internal face of the cylinder 22. An external annular boss 29 of the tube 26 is arranged thereon at a location in which, with the entire device in the conventional core drilling position, it keeps the balls 27 locked in the position described hereinabove so as to form a connection between the cylinder 22 and the piston 23. A locking rod 30, fixed through the piston 23 and the sliding tube 26, holds the latter in the position in which it locks the balls 27. At its rear end (viewed according to the direction S), the sliding tube 26 has a valve seat 31 intended, as a closure valve, to accommodate a ball 32 and is inserted leaktightly in the core drilling fluid inlet conduit 33 in this position for locking the balls 27. A first set of fluid passages 34 and a second set of fluid passages 35, all transversal to the wall of the sliding tube 26, are each located at a different level therein.

During normal core drilling, the core drilling fluid from the conduit 33 passes through the valve seat 31, flows into the sliding tube 26 and emerges therefrom via, among other things, the set of passages 34 to emerge, via flow holes 36, in the aforementioned flow space 5.

When it is desired for maximum restriction to be commanded at the front end 7 from the surface, the ball 32 is thrown into the path of the fluid and becomes seated on the valve seat 31 and thus blocks off the normal flow of core drilling fluid. The pressure of the fluid therefore exerts its full effects on the ball 32 and on the entire cross section of the sliding tube 26, visible at its rear end inserted in the conduit 33. When said pressure increases through lack of escape flow across the valve seat 31, it is able to produce sufficient force on the sliding tube 26 to shear the locking rod 30. The sliding tube 26 thus released and driven back by the pressure slides in the piston 23 until it comes up against a stop as far as a point at which its annular boss 29 releases the locking balls 27 which therefore detach the piston 23 from the cylinder 22.

At the end of the sliding travel under the pressure of the fluid, the sliding tube 26 leaves the conduit 33. The core drilling fluid can therefore escape by passing around the rear end thus released of the sliding tube 26 and it enters the latter through the set of passages 35 or alternatively passes around the sliding tube 26 in an annular gap between this tube and the piston 23, to once more reach the flow space 5 via the flow holes 36.

The relative travel of the piston 23 in the cylinder 22 is limited, for example, by a peg 37 fixed to the piston 23 and by an oblong hole 38 cut in the wall of the cylinder 22. The peg 37 allows the piston 23 to have a travel which is limited to the movement of the peg 37 from one end of this oblong hole 38 (as depicted in FIG. 2) to the other end of this same hole 38.

This limited relative travel is brought about by the pressure of the fluid on the outside of the inner tube 4. The latter, moved in the direction S, brings the restricting means 6 into a chosen maximum restriction position.

The core drill 1 according to the invention may comprise (FIG. 1) a kind of auxiliary device 40 intended, for example, to grip onto a core sample that is to be grasped in order to bring it to the surface. This auxiliary device 40 arranged coaxially in the front end 7 of the inner tube 4 may comprise a sleeve 41 with deformable wall 42, which allows the core sample to pass when it is in an undeformed starting condition. A substantially impervious annular chamber 43 of the device 40 is arranged between the inner tube 4 and the deformable wall 42 of the sleeve 41, this chamber 43 being in communication, via one or more holes 44 in the wall of the inner tube 4, with the core drilling fluid passing through the flow space 5. The wall 42 is chosen to deform toward the inside of the inner tube 4, until such time as it substantially closes up and/or closes the internal space 45 thereof so as to hold in a core sample located there, under the pressure of said fluid which pressure is obtained in the annular chamber 43 after an aforementioned adjustment of the pressure using the chosen maximum restriction.

The core drill 1 according to the invention may comprise (FIG. 3) another kind of auxiliary device 49 intended, for example, to form a relatively plain passage at the front end 7 of the inner tube 4, particularly at the location of known means 50 used for gripping and/or grasping a core sample, such as a split frustoconical ring. The auxiliary device 49 may comprise, arranged coaxially in the front end 7 of the inner tube 4, a sliding ring 51 which allows a core sample to pass and is mounted in the manner of a piston in a substantially impervious annular chamber 52 contained between the inner tube 4 and this ring 51. The chamber 52 communicates, via one or more holes 53 pierced in the inner tube 4, with the core drilling fluid passing through the flow space 5 between the outer 3 and inner 4 tubes. The sliding ring 51 can occupy a first position (shown in FIG. 3) slid toward the front end 54 of the core drill 1, and preferably can be locked in this position by a catch 55, and can be slid into a second position away from the front end 54 of the core drill 1 under the pressure of said fluid which pressure being obtained in the annular chamber 52 in communication with the hole(s) 53 after the pressure has been increased by the chosen maximum restriction. This takes place after any catch 55 that may be present has released the ring 51 under the action of said pressure on the ring 51. This catch 55 may be a locking rod which breaks under the force of a chosen pressure, acting to cause the ring 51 to slide.

The ring 51 may comprise, when viewed along its length and in succession from its rear end to its front end,

- a relatively thin wall 56 concealing an open section of the annular chamber 52, in said first position,
- a circular flange 57 acting as a piston head,
- a relatively thick wall 58 to withstand the pressure of the fluid and which collaborates with the inner tube 4 to form the annular chamber 52, and
- a wall 59, preferably a relatively thin wall, intended to conceal from the core sample in the inner tube 4 the means 50 which are designed to grip this sample in order to extract it from the bore hole.

The inner tube 4 may then comprise an internal shoulder 60, opposite the flange 57 of the ring 51 and intended to close the annular chamber 52. The longitudinal dimension of the annular chamber 52 is chosen so that the travel of the ring 51 therein allows the means 50 intended to grip the core sample to be released so that these means can act.

Advantageously, the inner tube 4 is fixed to the outer tube 3 in such a way that if the core sample should become jammed in the inner tube 4, the latter can be pushed back toward the rear end of the core drill 1. In this case, it is practical for the inner 4 and outer 3 tubes to comprise throttling means 65 which collaborate when the inner tube 4 is pushed back, so as to increase the pressure of the core drilling fluid. Such an increase in pressure can be interpreted at the surface as being a signal that there is a jam in the inner tube 4.

Said throttling means 65 may be combined (FIGS. 3 and 4) with the aforementioned element 10 of inner tube 4 and/or that 11 of the outer tube 3. The latter therefore preferably has, on the internal annular boss 11, a circular face 66 which collaborates with an additional external annular boss 67 of the inner tube 4 to perform the aforementioned throttling when the inner tube 4 is driven back inside the outer tube 3 by a core sample, this tube being suspended in the outer tube 3 only by the thrust ball bearing 25 pushed back against the outer tube by the pressure of the fluid.

In FIG. 2, the throttling means 65 are shown arranged on the rear end side of the inner tube 4, near the point at which it is suspended in the outer tube 3. The flow holes 36 open into the flow space 5 near the wall of the outer tube 3. Higher up (according to the drawing) than the flow holes 36, the wall of the outer tube 3 has an inside diameter which is smaller than it is below or even with these flow holes 36 when they are in a conventional core-drilling relative position of the inner 4 and outer 3 tubes. As the inner tube 4 is suspended by the thrust ball bearing 25 resting against the outer tube 3, if the inner tube 4 is pushed back in the opposite direction to the direction S, in the outer tube 3 as a result of a core sample becoming stuck in the inner tube 4 or for any other reason, the flow holes 36 come opposite the smallest diameter of the outer tube 3. The fluid is throttled and its pressure rises and this increase in pressure can again be interpreted at the surface.

It goes without saying to the person skilled in the art that in the above explanations it may be considered that the outer tube 3 and the coring bit 2 can form just one assembly, at least as far as the functions and internal elements thereof are concerned. Thus, elements described hereinabove as forming part of the outer tube 3 may, however, be in the coring bit 2, whether this be in the drawings or in the embodiments not depicted in these drawings.

In addition, the inner tube 4 may be considered as comprising the parts which are suspended in the outer tube 3 via the thrust ball bearing 25, the conduits 33 for conveying fluid, etc.

The aforementioned catch or catches 24, 55 may comprise or consist of one or more bodies of material and cross section chosen to break under the action of the pressure corresponding to the unlocking considered.

It is to be understood that the invention is not in any way restricted to the embodiments described and that many modifications can be made to the latter without departing from the scope of the claims appended to this description.

Figure 6:
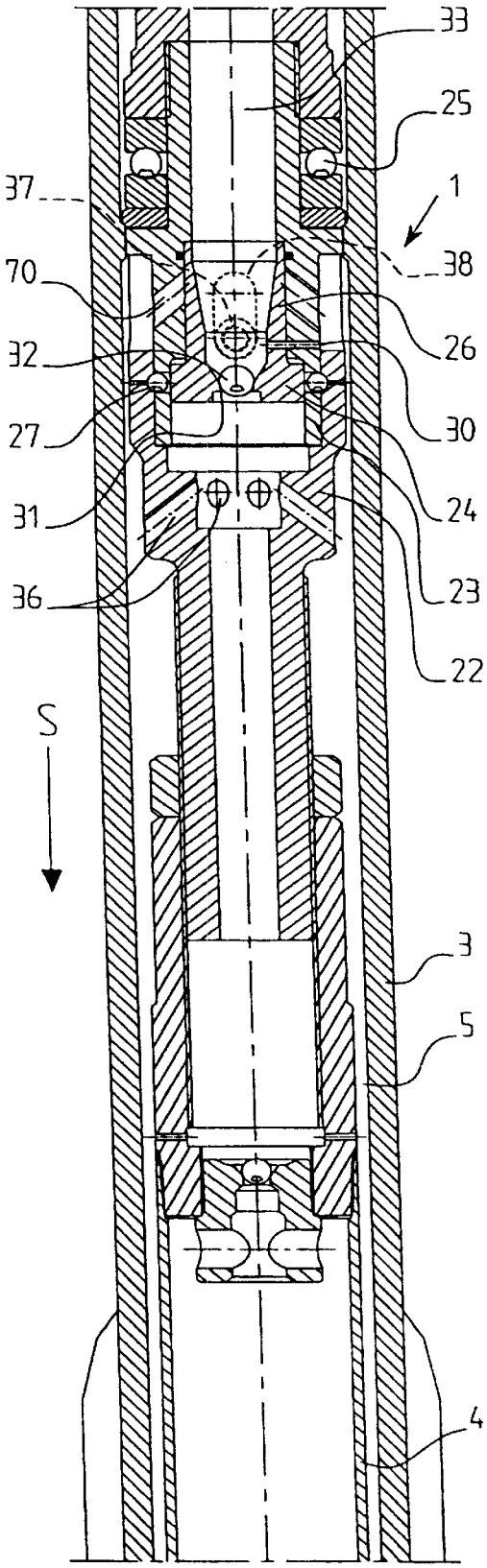
FIG. 6 depicts another embodiment of the portion of the core drill of the invention at the location of the rear end of the inner tube.

Thus, in the embodiment of FIG. 6, the catch 24 comprises a sliding tube 26 which differs somewhat from the previous one.

When the ball 32 arrives on the valve seat 31 of this sliding tube 26 and the pressure of the fluid applied to it breaks the locking rod 30, aside from operating in the way described hereinabove, the sliding tube 26 continues its longitudinal travel and rests on the cylinder 22, to assist the latter in causing the inner tube 4 to advance in the direction S.

Before the ball 32 was sent into the conduit 33, the core drilling fluid was flowing from the conduit 33 across the valve seat 31 and through the flow holes 36 as far as the flow space 5. After the ball 32 has closed the valve seat 31, and the sliding tube 26 has completed its travel, the fluid passes from the conduit 33 toward passages 70 and then, through the gap between the outer 3 and inner 4 tubes, to the flow space S.

Figure 4:
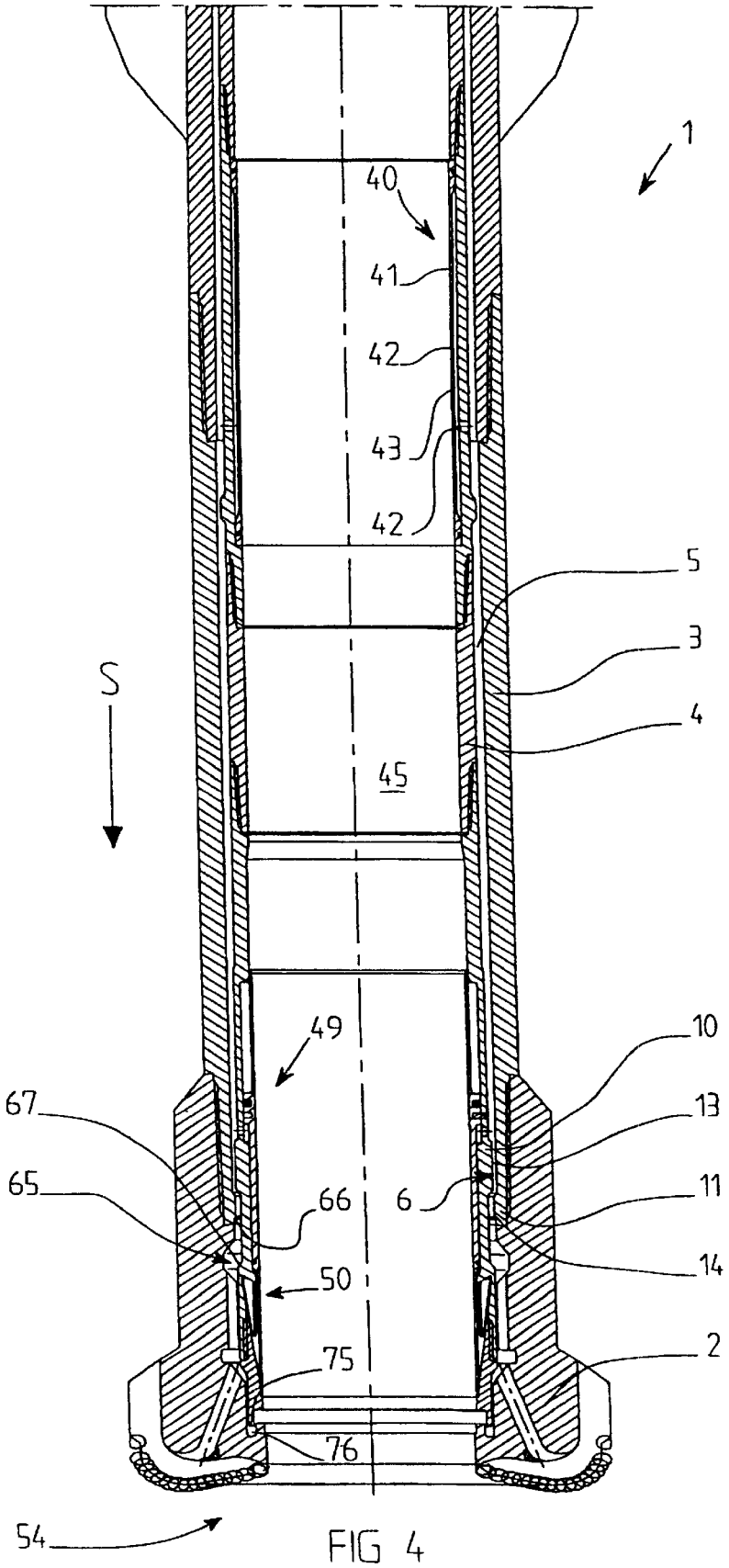
FIG. 4 depicts a front end of one embodiment of the core drill of the invention, equipped with a combination of two auxiliary devices.

FIG. 4 shows a combination of the means 50 for gripping the core sample and of the auxiliary devices 49 and 40 explained hereinabove. Starting from the front end 54 of the core drill 1, we find the gripping means 50, and an auxiliary device 49 designed to conceal the latter from a core sample so that this core sample "sees" a relatively plain passage and, above that, another auxiliary device 40 with a gripping sleeve 41 as described above.

Figure 5:
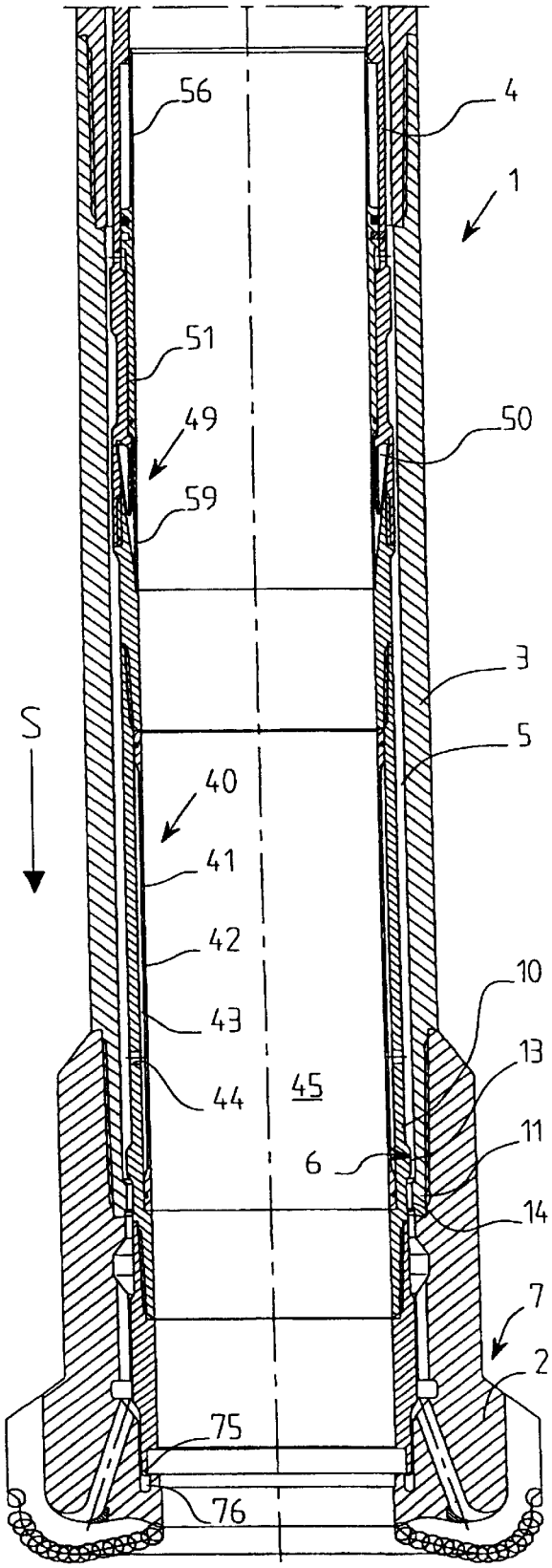
FIG. 5 depicts a front end of one embodiment of the core drill of the invention, equipped with another combination of two auxiliary devices.

FIG. 5 shows a combination, which is the reverse by comparison with that of FIG. 4, of the same means 50 for gripping the core sample and auxiliary devices 49 and 40.

Figure 7:
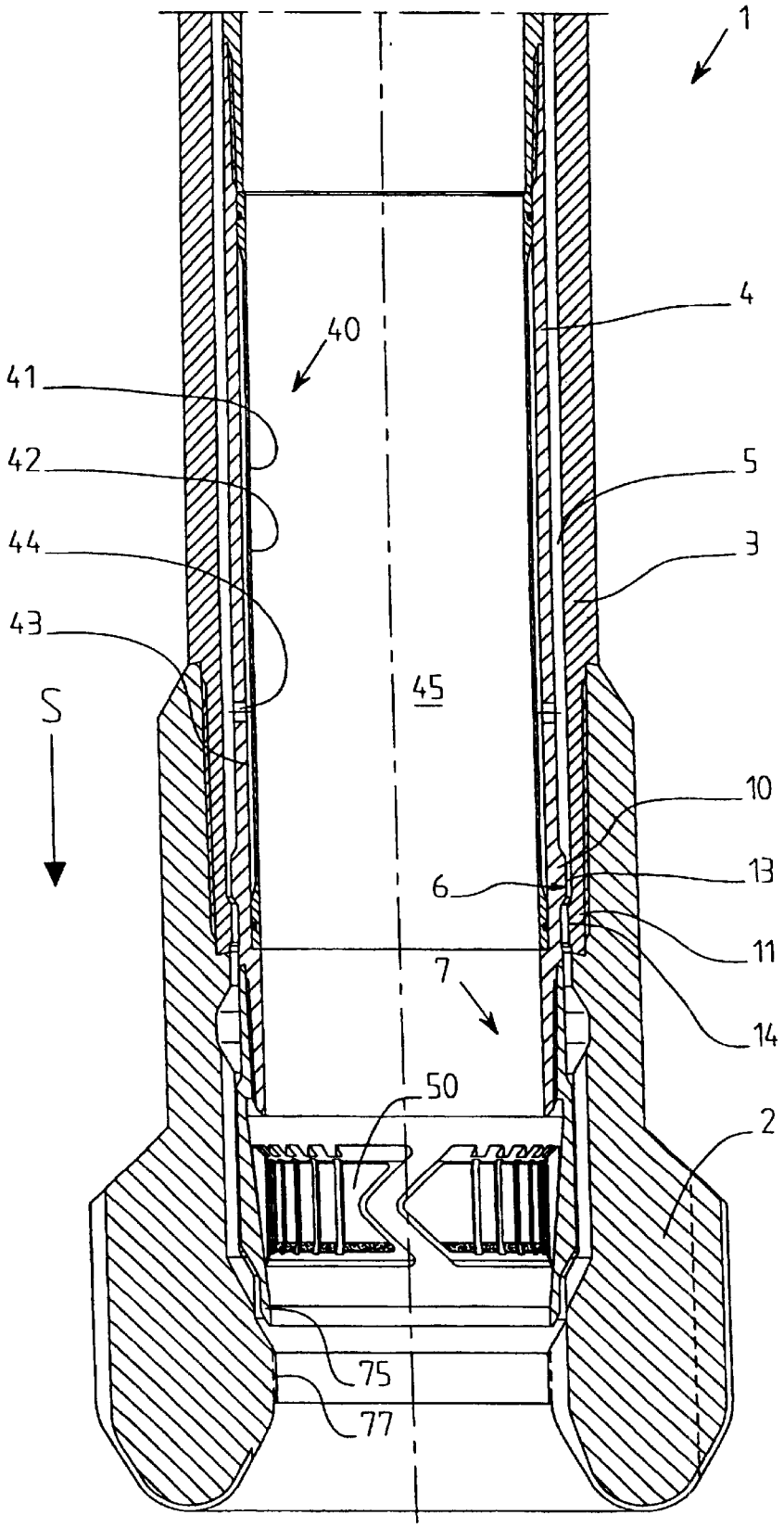
FIG. 7 depicts a front end of another embodiment of the core drill of the invention.

FIGS. 1, 3, 4, and 5 show the invention in the case of an inner tube end 75 which is thinned in terms of its thickness and arranged in an annular groove 76 extending in the direction of the axis of the core drill 1 toward the bottom of the bore hole. FIG. 7 shows the invention in a different configuration of the end 75 of the inner tube with respect to the bore 77 of the coring bit 2, it being possible for the latter end 75 to then be brought closer to the bottom of the bore hole than the end pushed into the groove 76.

KEY TO THE REFERENCE NUMERALS USED IN THE FIGURES

1 core drill
2 core bit
3 outer tube
4 inner tube
5 flow space
6 means for restricting the passage of fluid
7 front end of 4
8 control means
9 rear end of 4
10 element of the inner tube 4
11 element of the outer tube 3
13 external annular boss of 10
14 internal annular boss of 11
22 cylinder
23 piston
24 catch
25 thrust ball bearing
26 sliding tube
27 locking balls
28 scallops or annular groove
29 external annular boss of 26
30 locking rod
31 valve seat
32 valve ball
33 inlet conduit
34 fluid passage(s) of 26
35 fluid passage(s) of 26
36 flow hole(s)
37 peg of 23
38 oblong hole of 22
40 auxiliary device
41 grasping sleeve
42 deformable wall
43 annular chamber
44 hole(s) in 4
45 internal space of 4
49 another kind of auxiliary device
50 means for gripping and/or grasping a core sample
51 sliding ring
52 annular chamber
53 hole(s) in 4
54 front end of 1
55 catch
56 wall of 51
57 circular flange of 51
58 wall of 51
59 wall of 51
60 internal shoulder of 4
65 throttling means
66 circular face of 11
67 additional external annular boss of 4
70 passage(s)
75 front end of the inner tube 4
76 annular groove of 2
77 bore of 2
S direction of advance

What is claimed is:

1. A core drill, in particular for oil prospecting, comprising:

a core bit (2), an outer tube (3) supporting the core bit (2) so as to drive the core bit rotation for core drilling, an inner tube (4) mounted in the outer tube (3) so that the inner tube can receive a core sample cut by the core bit (2), a flow space (5) provided between the outer (3) and inner (4) tubes and intended for the passage of a core drilling fluid to be conveyed to a bottom of a hole during core drilling, wherein passage restricting means (6) for restricting the passage of fluid are arranged in the flow space (5) at the front end (7) side of the inner tube (4), viewed according to a direction of advance (S) of a core sample, control means (8) are provided for adjusting, from the surface, the restricting means (6) so as to increase a pressure of said fluid upstream of the restricting means (6), the passage-restricting means (6) comprise an element (10) of inner tube (4) and an element (11) of outer tube (3) which elements (10 and (11) collaborate to produce an adjustable restriction, the control means (8) are designed to move the inner (4) and outer (3) tubes one with respect to the other, the control means (8) are designed to move the inner (4) and outer (3) tubes longitudinally one with respect to the other with a view to adjusting the adjustable restriction, and wherein, for the longitudinal movement, the control means (8) comprise, on the rear end (9) side of the inner tube (4), a cylinder (22) and piston (23) assembly with a limited travel, one of which cylinder (22) and piston (23) is secured to the inner tube (4) and the other of which cylinder (22) and piston (23) is secured to the outer tube (3), a catch (24) locks the piston (23) in the cylinder (22) in a position that corresponds to a chosen minimum restriction of said passage restricting means (6), and the catch (24) is designed to unlock the piston (23) from the cylinder (22) when a determined pressure of core drilling fluid, higher than the core-drilling pressure of said core drilling fluid is applied to the catch (24), the limited travel of piston (23) relative to cylinder (22) as a result of a pressure of core drilling fluid which is still higher than said determined pressure, bringing the restricting means (6) from the front end (7) of the inner tube (4) into a position of chosen maximum restriction of said passage restricting means (6).

2. A core drill, in particular for oil prospecting, comprising:

a core bit (2), an outer tube (3) supporting the core bit (2) so as to drive the core bit rotation for core drilling, an inner tube (4) mounted in the outer tube (3) so that the inner tube can receive a core sample cut by the core bit (2), a flow space (5) provided between the outer (3) and inner (4) tubes and intended for the passage of a core drilling fluid to be conveyed to a bottom of a hole during core drilling, wherein passage restriction means (6) for restricting the passage of fluid are arranged in the flow space (5) at the front end (7) side of the inner tube (4), viewed according to a direction of advance (S) of a core sample, control means (8) are provided for adjusting, from the surface, the restricting means (6) so as to increase a pressure of said fluid upstream of the restricting means (6), and which comprises, arranged coaxially in the front end (7) of the inner tube (4), a sliding ring (51) allowing the passage of a core sample and mounted in the manner of a piston (23) in an annular chamber (52) contained between the inner tube (4) and this ring (51), this chamber (52) being in communication with the core drilling fluid passing through the flow space (5) between the outer (3) and inner (4) tubes, the sliding ring (51) being capable of occupying a first position slid towards the front end (54) of the core drill (1), and being slid into a second position away from the front end (54) of the core drill (1) under the pressure of said core drilling fluid obtained in the annular chamber (52) after the increase in the aforementioned pressure of said core drilling fluid by the chosen maximum restriction, after the catch (55) there might be has released the ring (51) under the action of pressure of said core drilling fluid on this ring.

3. A core drill, in particular for oil prospecting, comprising:

a core bit (2), an outer tube (3) supporting the core bit (2) so as to drive the core bit rotation for core drilling, an inner tube (4) mounted in the outer tube (3) so that the inner tube can receive a core sample cut by the core bit (2), a flow space (5) provided between the outer (3) and inner (4) tubes and intended for the passage of a core drilling fluid to be conveyed to a bottom of a hole during core drilling, wherein passage restriction means (6) for restricting the passage of fluid are arranged in the flow space (5) at the front end (7) side of the inner tube (4), viewed according to a direction of advance (S) of a core sample, control means (8) are provided for adjusting, from the surface, the restricting means (6) so as to increase a pressure of said fluid upstream of the restricting means (6), and which comprises, arranged coaxially in the front end (7) of the inner tube (4), a sliding ring (51) allowing the passage of a core sample and mounted in the manner of a piston (23) in an annular chamber (52) contained between the inner tube (4) and this ring (51), this chamber (52) being in communication with the core drilling fluid passing through the flow space (5) between the outer (3) and inner (4) tubes, the sliding ring (51) being capable of occupying a first position slid towards the front end (54) of the core drill (1), and being slid into a second position away from the front end (54) of the core drill (1) under the pressure of said core drilling fluid obtained in the annular chamber (52) after the increase in the aforementioned pressure of said core drilling fluid by the chosen maximum restriction, after any catch (55) there might be has released the ring (51) under the action of pressure of said core drilling fluid on this ring and wherein, the ring comprises at least, when viewed in the direction of its length and, in succession, a circular flange (57) acting as a piston head, a wall (58) to withstand the pressure of the fluid and collaborating with the inner tube (4) to form the annular chamber (52), a wall (59) intended to conceal from the core sample in the inner tube (4) means (50) which are intended to grip this core sample so as to remove this core sample from the bore hole, the inner tube (4) comprises an internal shoulder (60) opposite the flange (57) of the ring, and intended to close the annular chamber (52), and the longitudinal dimension of the annular chamber (52) is chosen so that the travel of the ring (51) therein allows the inner tube means (50) intended to grip the core sample to be released.

4. A core drill, in particular for oil prospecting, comprising:

a core bit (2), an outer tube (3) supporting the core bit (2) so as to drive the core bit rotation for core drilling, an inner tube (4) mounted in the outer tube (3) so that the inner tube can receive a core sample cut by the core bit (2), a flow space (5) provided between the outer (3) and inner (4) tubes and intended for the passage of a core drilling fluid to be conveyed to a bottom of a hole during core drilling, wherein passage restricting means (6) for restricting the passage of fluid are arranged in the flow space (5) at the front end (7) side of the inner tube (4), viewed according to a direction of advance (S) of a core sample, control means (8) are provided for adjusting, from the surface, the restricting means (6) so as to increase a pressure of said fluid upstream of the restricting means (6), the passage-restricting means (6) comprise an element (10) of inner tube (4) and an element (11) of outer tube (3) which elements (10 and (11) collaborate to produce an adjustable restriction, the control means (8) are designed to move the inner (4) and outer (3) tubes one with respect to the other, the control means (8) are designed to move the inner (4) and outer (3) tubes longitudinally one with respect to the other with a view to adjusting the adjustable restriction, wherein, for the longitudinal movement, the control means (8) comprise, on the rear end (9) side of the inner tube (4), a cylinder (22) and piston (23) assembly with a limited travel, one of which cylinder (22) and piston (23) is secured to the inner tube (4) and the other of which cylinder (22) and piston (23) is secured to the outer tube (3), a catch (24) locks the piston (23) in the cylinder (22) in a position that corresponds to a chosen minimum restriction of said passage restoring means (6), the catch (24) is designed to unlock the piston (23) from the cylinder (22) when a determined pressure of core drilling fluid, higher than the core-drilling pressure of said core drilling fluid is applied to the catch (24), the limited travel of piston (23) relative to cylinder (22) as a result of a pressure of core drilling fluid which is still higher than said determined pressure, bringing the restricting means (6) from the front end (7) of the inner tube (4) into a position of chosen maximum restriction of said passage restricting means (6), and the aforementioned catch (24) comprises one or more bodies of material and cross section which are chosen to break under the action of the pressure corresponding to the unlocking in question.

* * * * *